United States Patent [19]

Gross et al.

[11] 4,341,979

[45] Jul. 27, 1982

[54] FLUORESCENT LAMP WITH ROTATING MAGNETIC FIELD ARC SPREADING DEVICE

[76] Inventors: Leo Gross, 3611 217 St., Bayside, N.Y. 11361; S. Merrill Skeist, 1620 Cedar Swamp Rd., Brookville, Glen Head, N.Y. 11545

[21] Appl. No.: 102,547

[22] Filed: Feb. 14, 1980

[51] Int. Cl.[3] ..... H01J 7/44; H01J 17/34; H01J 19/78; H01K 1/62

[52] U.S. Cl. ..... 315/57; 313/161; 315/62; 315/70

[58] Field of Search ..... 315/56, 57, 58, 59, 315/60, 62, 70, 85, 248; 313/161, 113, 488, 489

[56] References Cited

U.S. PATENT DOCUMENTS

| | | | |
|---|---|---|---|
| 2,030,401 | 2/1936 | Ruff | 315/56 |
| 2,087,753 | 7/1937 | Davies | 315/62 |
| 2,298,581 | 10/1942 | Abadie | 315/62 X |
| 2,411,510 | 11/1946 | Abadie | 315/62 X |
| 2,518,248 | 8/1950 | Ohlund | 313/493 |
| 3,225,241 | 12/1965 | Spencer et al. | 313/488 |
| 4,069,416 | 1/1978 | Suga | 313/161 |
| 4,119,889 | 10/1978 | Hollister | 315/248 |
| 4,187,446 | 2/1980 | Gross et al. | 315/58 |

*Primary Examiner*—Saxfield Chatmon, Jr.

[57] ABSTRACT

An arc discharge device such as a fluorescent lamp comprising an outer envelope having an inner phosphor coating. A rotating field magnetic arc spreading device is disposed in close proximity to the envelope at each end of the lamp envelope. The envelope has a circular cross section.

3 Claims, 4 Drawing Figures

FLUORESCENT LAMP WITH ROTATING MAGNETIC FIELD ARC SPREADING DEVICE

REFERENCE TO RELATED APPLICATIONS

This application is copending with the applications Ser. No. 834,651, filed Sept. 21, 1977, and Ser. No. 045,589, filed June 4, 1979.

BACKGROUND OF THE INVENTION

1. Field of the Invention

The present invention relates to a fluorescent lamp with greater efficacy than conventional fluorescent lamps. The application of rotating magnetic fields constrains the arc to flow close to the phosphored surface thereby increasing light output.

2. Description of the Prior Art

The present invention applies the technique of magnetic arc spreading coils described in the co-pending patent applications, Ser. Nos. 834,651 and 045,589 to straight line fluorescent lamps of any diameter.

SUMMARY OF THE INVENTION

The present invention applies a rotary magnetic field to the arc discharge within a fluorescent lamp constraining the arc to flow close to the phosphored surface of the fluorescent lamp envelope. The current within the arc, lying closer to the phosphor, generates UV quanta which have a greater probability of producing visible light. Thus, fluorescent lamps according to the present invention with arcs constrained by a rotating magnetic field have greater efficacy than conventional fluorescent lamps. Lamps applying rotating magnetic fields can be made with larger diameters than conventional fluorescent lamps.

DETAILED DESCRIPTION OF THE INVENTION

Figure 1:
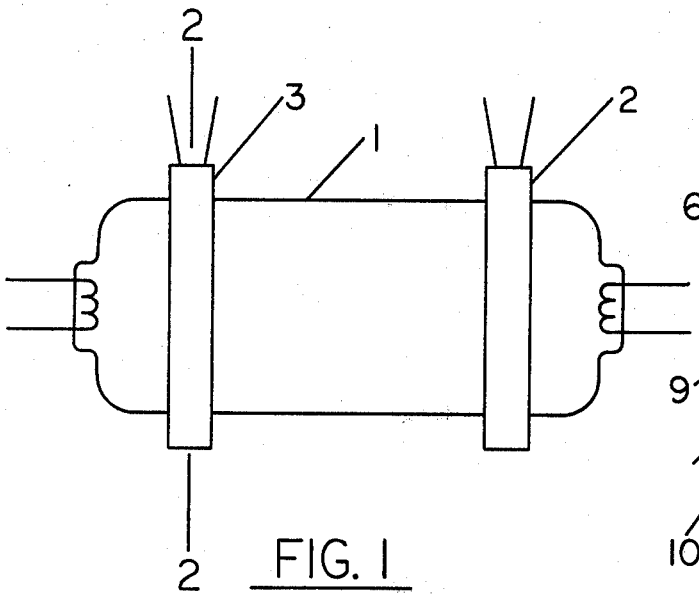
FIG. 1 illustrates a version of a fluorescent lamp with circular cross section wherein the arc is driven by a rotating magnetic field.

A lamp envelope 1 having a circular cross section is shown in FIG. 1. The lamp envelope has its inner surface provided with a phosphored coating. When an arc discharge is sent through the lamp envelope 1, without energizing the rotating magnetic field, the arc current flows through the center of the lamp envelope 1 between filaments and activates the phosphor less effectively than when the current flows close to the phosphored surface. In the present invention the rotating magnetic field produces a constant amplitude rotating vector driving the arc current close to the phosphored surface. The rotating field is generated by coils 2 and 3, which when properly phased, force the arc to flow close to the phosphored inner surface of the lamp envelope.

Figure 2:
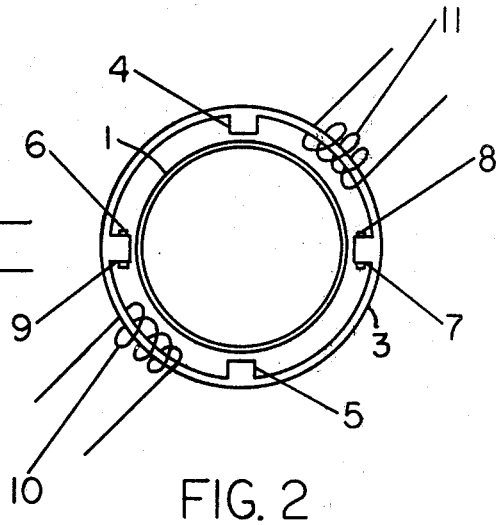
FIG. 2 is a sectional view of the lamp in FIG. 1 taken along the plane of line 2—2 in FIG. 1.

One means of generating rotating magnetic fields is by a quadrupole ring, similar to the field coil of a shaded pole motor. As shown in FIG. 2, each coil 2, 3 includes two opposing poles 4 and 5 which are energized directly by coils 10 and 11 connected in series to the source of power. The fields produced by poles 6 and 7 are delayed 90 degrees in phase from reaching peak magnitude by shorted turns 8 and 9. This creates a field across poles 6 and 7 90 degrees out of phase with poles 4 and 5. Under the driving force of a 60 Hz power line, the magnetic field rotates with a 30 Hz frequency.

Since UV light produces by activated Hg ions in the plasma of the arc may be absorbed if the UV quanta encounter ground state atoms, a portion of the UV quanta does not reach and activate phosphor to produce visible light. The probability is increased, the greater the distance the UV quanta must traverse to reach the phosphor. For this reason, light output is increased when the current is forced to flow close to the phosphored surface. However, UV quanta emitted in the reverse direction have a reduced likelihood of reaching the far wall and being converted to visible light. To product more light from a larger phosphored area, the lamp diameter is increased beyond the conventional T-12 lamp size, a 38 mm (1.5″) diameter.

Figure 3:
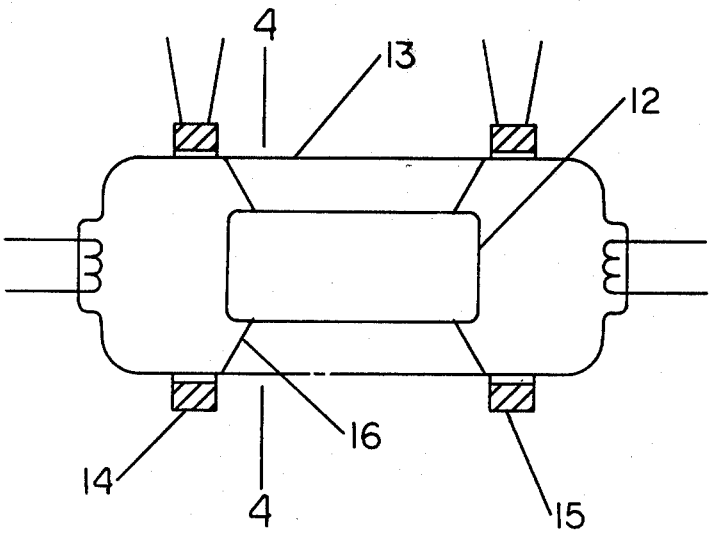
FIG. 3 shows a version of a fluorescent lamp with a rotating magnetic field containing an internal structure with a phosphored surface; and, FIG. 4 is a sectional view taken along the plane of line 4—4 in FIG. 3.

To convert more UV quanta to visible light, an internal cylindrical structure 12 having an exterior phosphored surface is placed coaxially in the lamp envelope 13 as shown in FIG. 3. The coil 14 and 15, similar to coils 2 and 3, producing the rotating magnetic field, constrain the arc to rotate close to the phosphored surface of the lamp envelope 13 and around and close to the phosphored surface of the inner structure 12.

Figure 4:
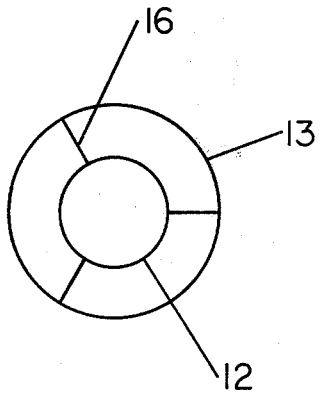

The inner structure is supported by three legs 16 at each end, as seen in FIG. 4. To increase light output further, the exterior surface of this inner structure 12 has a reflective coating underneath the phosphor. The generation of a rotating magnetic field to drive the arc close to and around a circular cylindrical fluorescent lamp increases the light output with increasing lamp diameter, since more phosphored surface is available for activation. Consequently, rotating magnetic field lamps with greater efficacy than conventional fluorescent lamps have diameters of 76 mm (2″) and greater. The coils generating the rotating magnetic field can be at least a part of the conventional fluorescent lamp ballast.

What is claimed is:

1. A fluorescent lamp comprising an envelope having a phosphored surface, and means at each end of the lamp to create a rotating magnetic field to force the arc of the lamp to flow close to phosored surface and increase the light output of the lamp, said means comprises filed coils for producing said rotating magnetic field, said coils being arranged in pairs and included opposed pairs of poles and means for 90 degree phase delaying one pair of said coils with respect to the other pair of said coils.

2. A fluorescent lamp according to claim 1, containing an externally phosphored reflective inner structure coaxial with said lamp envelope.

3. A fluorescent lamp according to claim 2, wherein said envelope is of any diameter larger than 38 mm (1.5″).

* * * * *